US009433049B2

(12) United States Patent
Scott

(10) Patent No.: US 9,433,049 B2
(45) Date of Patent: Aug. 30, 2016

(54) LED CONTROLLERS, DRIVERS AND LIGHTING CIRCUITS

(71) Applicant: NXP B.V., Eindhoven (NL)

(72) Inventor: Michael Scott, Worksop (GB)

(73) Assignee: NXP, B.V., Eindhoven (NL)

( * ) Notice: Subject to any disclaimer, the term of this patent is extended or adjusted under 35 U.S.C. 154(b) by 0 days.

(21) Appl. No.: 14/955,827

(22) Filed: Dec. 1, 2015

(65) Prior Publication Data

US 2016/0157314 A1 Jun. 2, 2016

(30) Foreign Application Priority Data

Dec. 1, 2014 (EP) ..... 14195669

(51) Int. Cl.
*H05B 33/08* (2006.01)

(52) U.S. Cl.
CPC ..... *H05B 33/0827* (2013.01)

(58) Field of Classification Search
CPC ..... H05B 33/0818; H05B 33/0827; H05B 33/0842; H05B 33/0869; H05B 33/0815; H05B 37/029; H05B 37/0281; H03K 7/08; H03K 9/10
USPC ..... 315/152, 291, 294, 307, 312, 318, 360; 345/691, 94
See application file for complete search history.

(56) References Cited

U.S. PATENT DOCUMENTS 7,738,002 B2 * 6/2010 Ashdown ..... H03K 7/08 345/691
8,237,700 B2 * 8/2012 Zhao ..... H05B 33/0818 345/204
8,258,709 B2 * 9/2012 Moskowitz ..... H05B 33/0827 315/152
8,633,779 B2 * 1/2014 Pfaffinger ..... H03K 7/08 332/109
2011/0241919 A1 10/2011 Alderson
2012/0127210 A1 5/2012 Huang et al.
2013/0229215 A1 9/2013 Sadwick
2013/0300464 A1 11/2013 Kleinpenning et al.

FOREIGN PATENT DOCUMENTS

DE 10 2009 026 612 A1 12/2010
DE 10 2013 204 844 A1 10/2014
EP 2 432 124 A1 3/2012
WO WO-2006/039790 A2 4/2006
WO WO-2006/039790 A3 4/2006
WO WO-2010/051417 A1 5/2010
WO WO-2010/052506 A1 5/2010
WO WO-2012/000291 A1 5/2012

OTHER PUBLICATIONS

Extended European Search Report for Application 14195669.8 (May 29, 2015).

* cited by examiner

*Primary Examiner* — Haissa Philogene

(57) ABSTRACT

A controller for controlling a plurality of LED lighting strings is disclosed, the controller comprising, for each of the plurality of LED lighting strings: a frequency modulator configured to modulate a baseline frequency to generate a time-vary modulated frequency, wherein the frequency modulator is configured to modulate the baseline frequency by a jitter superposed on a regular repeating pattern which varies more slowly than the jitter, to result in the modulated frequency; and a modulated PWM signal generator configured to generate a modulated PWM signal having the modulated frequency and a predetermined duty cycle; wherein the regular repeating patterns for the PWM signals are spaced apart in phase. Associated drivers, LED lighting circuits and methods are also disclosed.

15 Claims, 7 Drawing Sheets

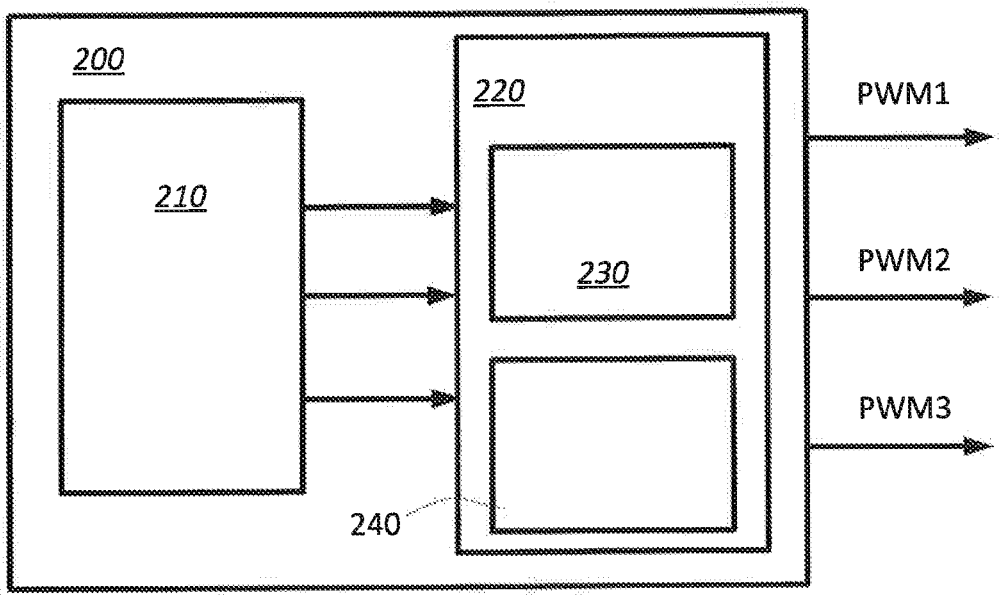
Figure 2(a)
Figure 2(b)
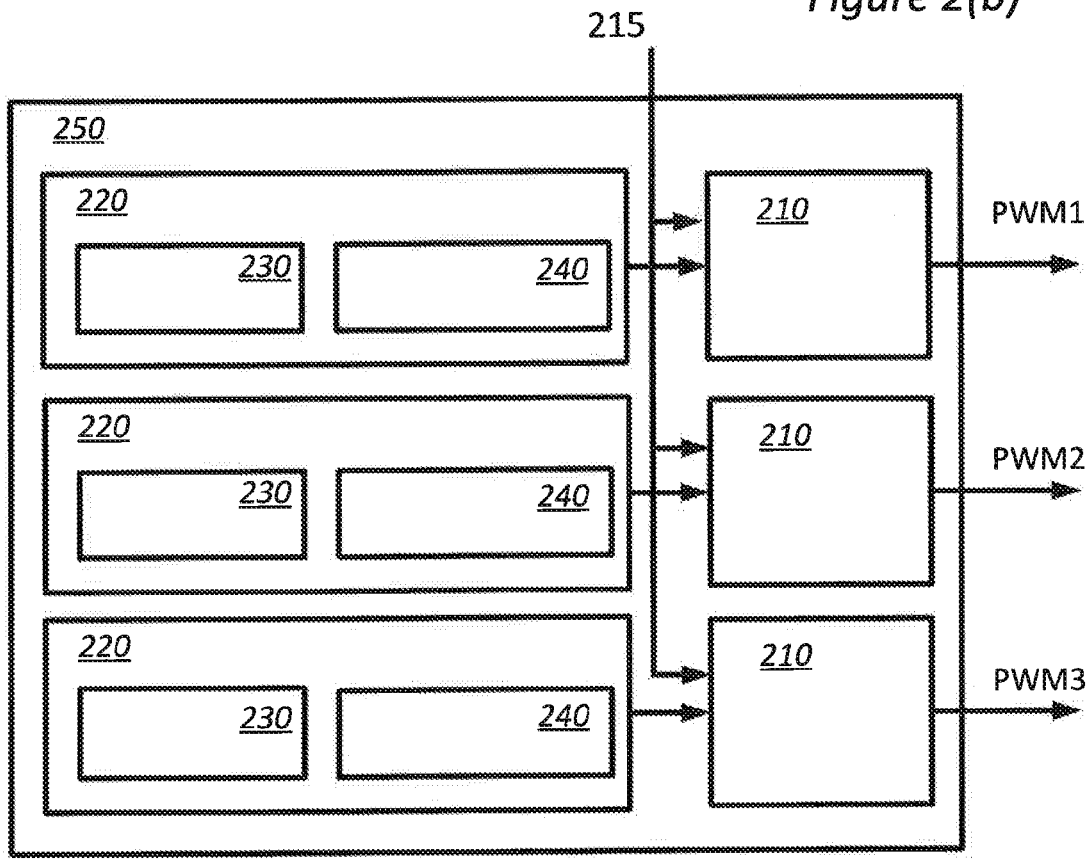

LED CONTROLLERS, DRIVERS AND LIGHTING CIRCUITS

CROSS-REFERENCE TO RELATED APPLICATIONS

This application claims the priority under 35 U.S.C. §119 of European patent application no. 14195669.8, filed Dec. 1, 2014, the contents of which are incorporated by reference herein.

FIELD

The present disclosure relates to a controllers and drivers for controlling and driving a plurality of LED lighting strings. It further relates to LED lighting strings driven by such controllers and to methods of controlling LED lighting strings.

BACKGROUND

To control multiple strings of LED lights—for instance for backlighting applications, or for red-green-blue (RGB) colour variable lighting—it is known to provide pulse-width modulation (PWM) signals to a respective switch for each string, to turn that string on and off: the greater the proportion of the cycle the string is turned on (that is, the higher the 'mark-space ratio', or duty-cycle of the PWM signal), the brighter the light output from the string. In the example case of RGB strings, the colour of the resultant combined light may be varied by altering the duty cycle of one or more of the PWM signals.

Typically such multi-string LED PWM control schemes use a common, fixed, frequency, often in the range of 200 to 400 Hz. Particularly in the case that the PWM switching for these strings is coincident, this can result in significant electromagnetic interference (EMI) since the switching transients occur at the same frequency and may even be coincident. Further, in applications in which a switch mode power supply (SMPS) is used to provide power, the output stage of the switch mode power supply may be stressed, and may produce audible noise at the PWM switching frequency.

It has been proposed to alleviate the EMI by introducing a random PWM control to the switching, such as is proposed in United States patent application, publication number US 2012/0127210 by Huang et al.

SUMMARY

According to a first aspect of the present invention, there is provided a controller for controlling a plurality of LEDs lighting strings, the controller comprising, for each of the plurality of LED lighting strings: a frequency modulator configured to modulate a baseline frequency to generate a time-varying modulated frequency; wherein the frequency modulator is configured to modulate the baseline frequency by a jitter superposed on a regular repeating pattern which varies more slowly than the jitter, to result in the modulated frequency; and a modulated signal generator configured to generate a modulated PWM signal having the modulated frequency and a predetermined duty cycle; wherein the regular repeating patterns for the PWM signals are spaced apart in phase.

By including a combination of jitter and a regular repeating pattern, it may be possible to reduce the level of randomness, whilst still benefiting from the limited negative correlation between switching of the LED strings. It may thereby be possible, for instance, to mitigate or reduce EMI problems. Furthermore, it may be possible to reduce or mitigate random loading on the power supply, which is generally associated with truly random frequency. Modulating the frequency, but using the predetermined duty cycle may allow the controller to adjust the PWM signals without introducing variation to the average currents, and thus the perceived light output is not directly affected. The baseline frequency and modulated frequency may each be embedded or represented in a respectively signal, or they may be represented as information which is not embedded or encoded in a signal.

In one or more embodiments the jitter is random. Alternatively, in some embodiments it may be possible to include jitter having a quasi-random nature or even a regular periodic pattern.

In one or more embodiments, each frequency modulator comprises: a jitter module configured to adjust the respective baseline frequency by a random amount; and an envelope shaper module configured to adjust the respective baseline frequency according to a regular repeating pattern, operable in combination with the jitter module. This may allow for the same envelope shaper to be used for each of the LED lighting strings, whereas different jitter is applied to each string. In particular in the case that the jitter is random, a separate random number may be generated for each PWM cycle for each of the LED lighting strings.

In one or more embodiments, the regular repeating pattern is one of a triangular and a saw-tooth pattern. Other appropriate regular repeating patterns, such as a sinusoidally varying pattern, are also envisaged. Some of these will be described below.

In one or more embodiments the envelope shaper is configured to adjust the respective frequency of each PWM signal by the same regular repeating pattern. This may be reduce the complexity of the circuitry, or in the case that the controller is at least partially implemented in software, of the underlying algorithms.

In one or more embodiments the regular repeating pattern for different PWM signals are evenly spaced apart in phase. Thus for a colour LED lighting circuit in which there are, for instance, three LED lighting strings—red, green and blue respectively—the regular repeating pattern for strings may be offset by $\pm 2\pi/3$ from each other.

According to another aspect of the present disclosure, there is provided a driver for driving a plurality of LEDs lighting strings, comprising a controller as described above, and a plurality of power switches, each configured to be switched according to the respective modulated PWM signal.

The driver may further comprise a measuring units, configured to determine a period of time when none of the modulated PWM signals are high, and to calculate a characteristic of only one of the LED lighting strings within the period. The driver may thus be used in conjunction with sensorless sensing.

According to a yet further aspect of the present disclosure, there is provided a lighting circuit comprising such a driver and further comprising the plurality of LEDs lighting strings.

According to another aspect of the present disclosure, there is provided a method of controlling a plurality of LED lighting strings, the method comprising, for each of the plurality of LED lighting strings: modulating a baseline frequency to generate a time-vary modulated frequency, wherein the baseline frequency is modulated by a jitter superposed on a regular repeating pattern which varies more slowly than the jitter, to result in the modulated frequency; and generating a modulated PWM signal having the modulated frequency and a predetermined duty cycle; wherein the regular repeating patterns for the PWM signals are spaced apart in phase.

The jitter may be random. Each regular repeating pattern may be the same regular repeating pattern.

In one or more embodiments, the method may further comprise determining a period of time when none of the modulated PWM signals are high, and measuring a characteristic of a one of the LED lighting strings within the period.

These and other aspects of the invention will be apparent from, and elucidated with reference to, the embodiments described hereinafter.

BRIEF DESCRIPTION OF DRAWINGS

Embodiments will be described, by way of example only, with reference to the drawings, in which

FIG. 2(*a*) shows, in block form, a controller for controlling a plurality of LEDs lighting strings, according to one or more embodiments;

FIG. 2(*b*) shows, in block form, a controller for controlling a plurality of LEDs lighting strings, according to one or more embodiments and suitable for digital or software implementation;

Figure 1:
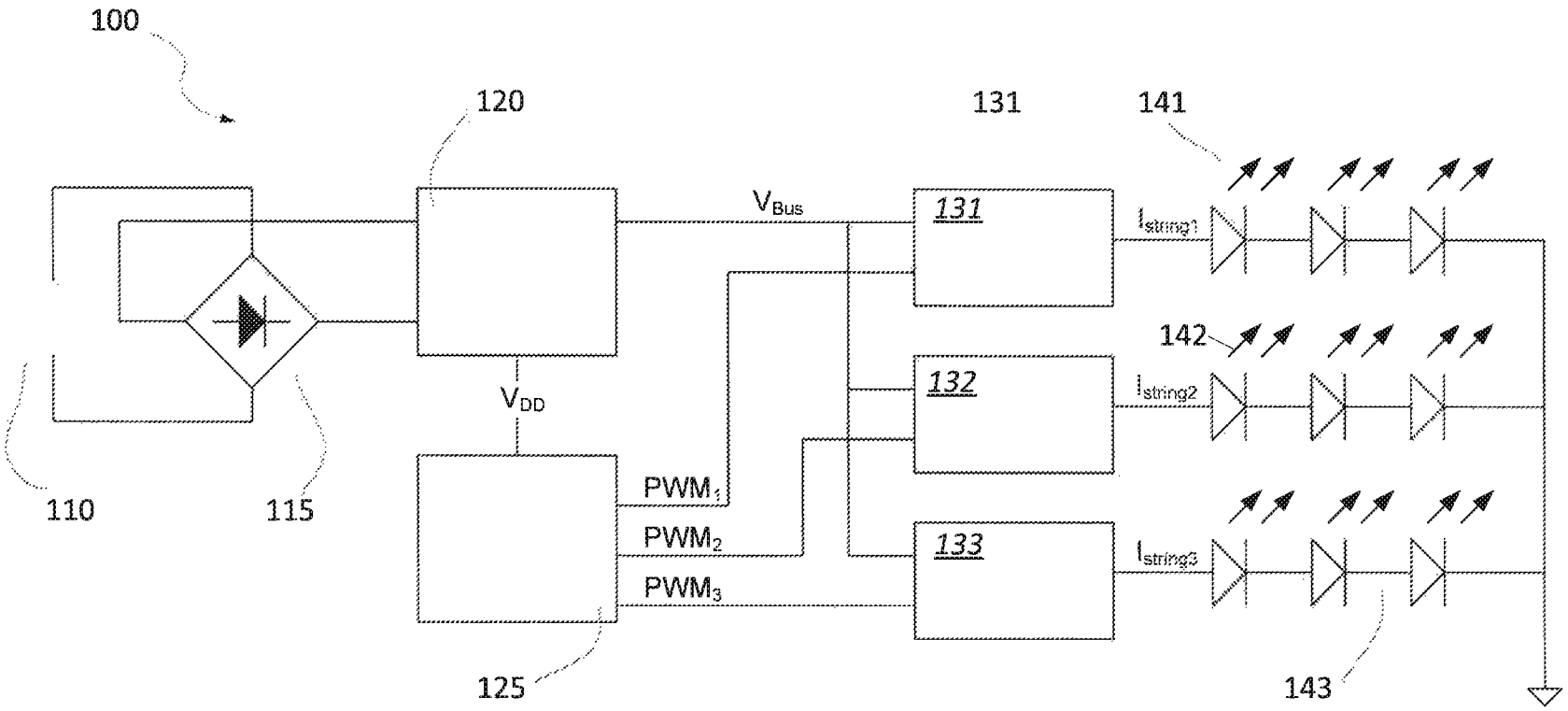
FIG. 1 illustrates an example of a generic mains-supplied multi-string LED lighting circuit.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar features in modified and different embodiments.

DETAILED DESCRIPTION OF EMBODIMENTS

An example of a generic mains-supplied multi-string LED lighting circuit 100 is shown schematically in FIG. 1. The circuit is powered from an AC mains 110 which is rectified by rectifier 115, and down converted to a suitable drive voltage $V_{DD}$ by a switch mode power supply (SMPS) or DC-DC converter 120. PWM control signals PWM1, PWM2 and PWM3 are produced by a PWM synthesiser, which may, as shown, be implemented in a microcontroller 125. The PWM control signals PWM1, PWM2 and PWM3 are used to control respective LED drivers 131, 132 and 133. The drivers drive respective LED strings 141, 142 and 143 with drive currents $I_{string1}$, $I_{string1}$ and $I_{string1}$.

FIG. 2(*a*) shows, in block form, a controller 200 for controlling a plurality of LEDs lighting strings, and which may be used in lighting circuits, for example such as that shown in FIG. 1, according to one or more embodiments. The controller comprises a PWM signal generator 210. The signal generator is configured to generate a respective PWM signal, for each of the plurality of LED lighting strings, each PWM signal having a frequency and a predetermined duty cycle. The controller comprises a frequency modulator 220 configured to adjust the frequency of each of the PWM signals to result in a respective modulated frequency. That is to say, PWM control signals PWM1, PWM2 and PWM3 output from the controller, have frequencies which derive from the frequency modulator 220. The frequency modulator is configured to adjust the frequency by a jitter, derived in the jitter module 230. The jitter is superposed on a regular repeating pattern, which varies more slowly than the jitter and is derived in an envelope shaper module 240. That is to say, the PWM-to-PWM cycle changes due to the jitter may be larger than the PWM-to-PWM cycle changes due to the pattern in the regular repeating pattern. The combination of the jitter and the regular repeating pattern results in a modulated frequency for each of the output PWM signals. The regular repeating patterns for the PWM signals are spaced apart in phase.

FIG. 2(*b*) shows, in block form, a controller 250 for controlling a plurality of LEDs lighting strings, according to one or more embodiments and suitable for digital or software implementation; similar to the embodiment shown in FIG. 2(*a*), the controller 250 comprises a frequency modulated 220 which comprises a jitter module 230 and an envelope shaper module 240. The controller further comprises a PWM signal generator 210. In embodiments according to FIG. 2, the PWM signal generator takes as inputs the modulated frequency, output from the frequency modulated 220, and information representative of a duty cycle 215. As will be discussed in more detail below, the modulated frequency and information representative of duty cycle may each be, in digital software component implementations, simply a number stored in a register (not shown). The PWM signal generator may then synthesise the PWM control signal PWM1 from this information. The combination of frequency modulator and PWM signal generator 210 is replicated for each of the LED lighting strings, to provide separate PWM control signals PWM1, PWM2, and PWM3.

Figure 3:
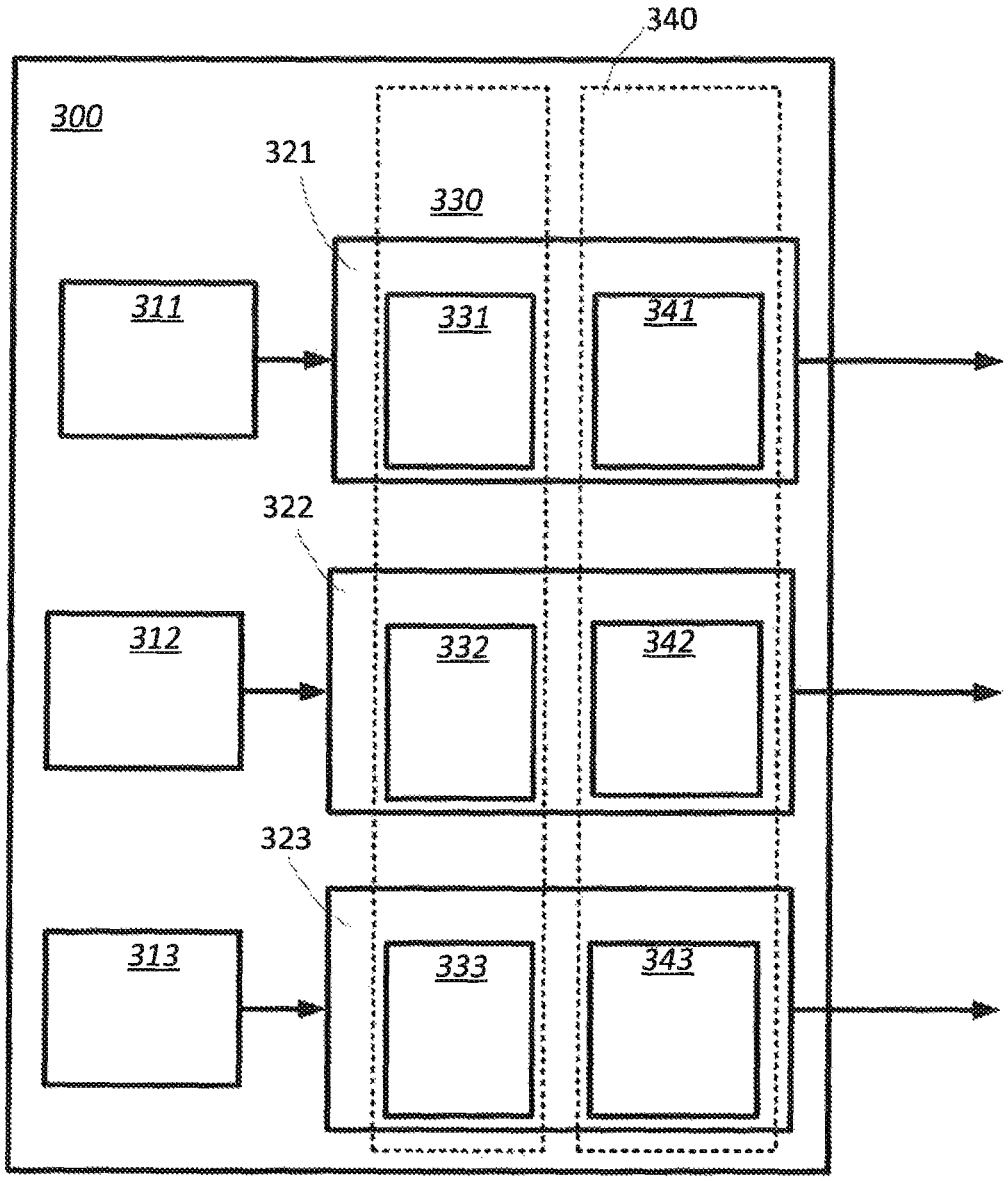
FIG. 3 shows, in block form, another controller for controlling a plurality of LEDs lighting strings, according to one or more embodiments.

FIG. 3 shows, in block form, another controller 300 for controlling a plurality of lighting strings, and which may be used in circuits, for example such as that shown in FIG. 1, according to one or more embodiments. In the embodiment depicted in this figure, a separate signal generator 311, 312 and 313 is provided for each Led lighting string. Each of the signal generators 311, 312, 313 provide a respective signal to corresponding jitter modules 331, 332 and 333, and envelope shaper modules 341, 342 and 343. Each jitter module and envelope shaper (331 and 341, 332 and 342, 333 and 343) forms a respective frequency adjustor modulator 331, 323, 323. The jitter modules 331, 332 and 333 together comprise a jitter unit 330, and the envelope shaper modules 341, 342 and 343 together comprise an envelope shaper unit 340.

Figure 4:
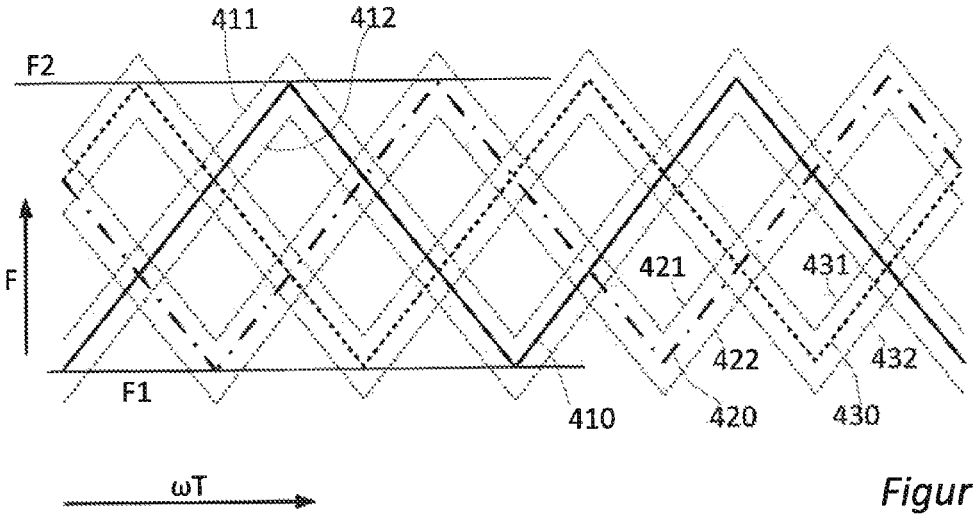
FIG. 4 shows schematically an example of frequency adjustment according to one or more embodiments.

An example of frequency adjustment according to one or more embodiments is shown schematically in FIG. 4, which depicts, on the y-axis or ordinate, PWM switching frequency F for each of three LED strings, against time (ωT) on the x-axis or abscissa. The PWM frequency for each string is modified by a regular repeating pattern, shown as 410, 420 and 430, which in this case is a symmetrical triangular waveform.

Figure 5:
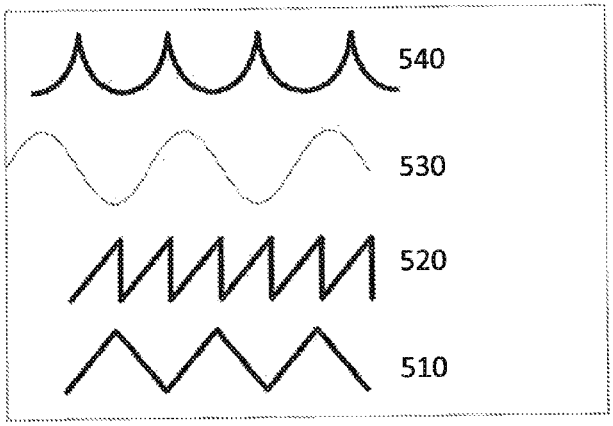
FIG. 5 shows non-exhaustive examples of alternative regular repeating patterns.

Non-exhaustive examples of alternative regular repeating patterns, which may be used, are shown in FIG. 5. These include symmetrical triangular waveform 510, sawtooth waveform 520, sinusoidal waveform 530, and skewed triangular waveform 540.

Returning to FIG. 4, in one example, a jitter is superposed on the regular repeating pattern. The skilled person would appreciate that the jitter may take a regular, or a random, form. The frequency of any individual PWM cycle will thus not be that determined directly by the regular repeating pattern. Rather, the frequency might be either higher or lower than that shown by plot 410, 420 or 430 respectively. The actual frequency for the first string at any moment in time will fall within an envelope which is defined by an upper limit of 411 and a lower limit 412. The plot 411 follows the regular repeating pattern for 410, but is displaced upwards by the maximum allowable positive jitter. Conversely the plot 420 follows the regular repeating pattern 410, but is displaced downwards by the maximum allowable negative jitter. Similarly, the actual frequency for the second string will lie within an envelope between upper limit 421 and lower limit 422; the actual frequency for the third string will lie within an envelope between upper limit 431 and lower limit 432.

Figure 6:
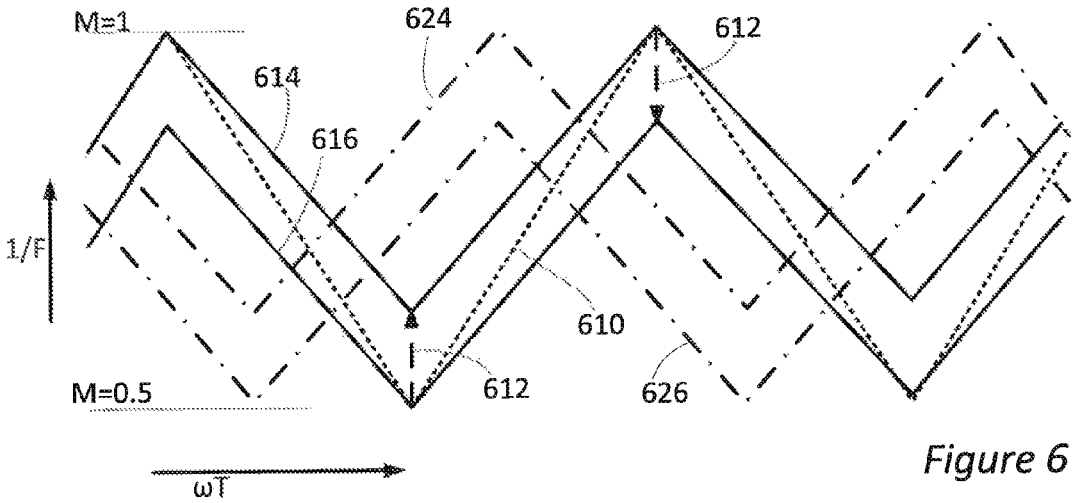
FIG. 6 shows another example of frequency adjustment.

FIG. 6 shows another example of frequency adjustment. This example is particularly suited to digital implementation. Instead of directly operating on the PWM frequency, the frequency adjustment is made by operating on its inverse—that is to say the period of an individual PWM cycle. So, instead of plotting frequency on the y-axis or ordinate against time ($\omega T$) on the x-axis or abscissa, in FIG. 6 the PWM period (1/F) is plotted on the y-axis. In this particular example, the regular repeating pattern is a triangular waveform for the PWM period. The skilled person will appreciate that the corresponding regular pattern, when considered as a pattern in frequency, is a "skewed" or "concave" triangular waveform such as that shown in FIG. 5 at 540.

The period 1/F may conveniently be described and calculated using a modulation index M, which is a multiplier applied to a baseline period. Thus, when M=1, the multiplier is 1; when M=0.5, the multiplier is 0.5. Hence, considering a non-limiting example in which the modulation index varies between M=0.5 and M=1, the baseline (that is to say, minimum) frequency, when M=1, of 244 Hz resulting in a baseline (that is to say maximum) period of $1/244$ s, the period varies between a maximum of $(1)*(1/244)$ s, that is to say approximately 4.1 ms, to a minimum of $(0.5)(1/244)$ s, that is to say, approximately 2.0 ms.

Superposed on the regular repeating pattern is a jitter, which in this case is a random jitter with a value between 0 and 255, generated according to the random number generator. The jitter is superposed on the regular repeating pattern by means of an "exclusive-or" (XOR) function. As a result, the modulated PWM frequency always is within an envelope defined by the regular repeating pattern. In the case that the PWM frequency is represented by a number stored in a register, the XOR function is particularly straightforward—only the least significant bits of the frequency adjusted according to the regular repeating pattern are affected; the number of bits being affected being determined by the maximum allowable jitter.

The superimposition of the jitter is shown pictorially in FIG. 6, in which the regular repeating pattern is shown by dotted line 610, and the maximum allowable jitter is shown by dashed line 612. Due to the 'exclusive or' combination of these two adjustments, the frequency is never less than the minimum of the regular repeating pattern, and never more than the maximum of the regular repeating pattern. This is depicted pictorially by the negative arrowheads on lines 612. The frequency of any particular PWM cycle thus falls within the envelope defined by the 'exclusive or' (XOR) combination of the regular repeating pattern and the maximum allowable jitter, and with upper limit 614 and lower limit of 616 (solid lines in FIG. 6).

In the case of an RGB LED driver there would typically be three PWM signals. The envelope of the frequency of a second of these signals is shown in FIG. 6 by upper limit 624 and lower limit 626. For the purposes of clarity, the generators for the regular repeating pattern and the jitter are not shown. Similarly, in order to improve the clarity of the figure, neither the generators nor the envelope for a third frequency envelope are shown.

It will be observed that the envelopes for the first and second PWM frequencies, and the second and third PWM frequencies, have "phase" relationships which typically are fixed phase relationships.

Note that this does not refer to the phase of the PWM switching, but rather to the "phase" of the regular repeating pattern. Although this is not necessary, the skilled person will appreciate that by evenly spacing the phase of regular repeating pattern, the correlation between the PWM switching may be minimised. This may be beneficial for embodiments in which the power is supplied by a switch mode power supply (SMPS), since it may allow an evenly spread load for the SMPS, thereby reducing the ripple at its output. The skilled person will appreciate that, in the case that the jitter is truly random, there may be no absolutely fixed phase relationship between the phases. However, significantly varying phase relationship may result in the effect known as heterodyning, and this may in some circumstances reduce or compromise the stability of the observed colour of the RGB output. It may be possible to avoid this, by phase-locking the PWM frequency signals, to avoid such heterodyning. Such phase locking of course does not refer to the relative phase of each PWM cycle, but to the relative phase of the regular repeating pattern according to which frequency of the PWM signal is modulated.

In a typical non-limiting example, the maximum PWM frequency may be 488 Hz, and the minimum frequency 244 Hz, as discussed above. [The positive-peak to positive-peak time of the symmetrical triangular waveform (that is to say the period of the regular repeating pattern) in a typical example may be approximately ⅓ of a second]: Taking the above-mentioned case as an example, the average PWM period—that is to say midway between the minimum and maximum periods is $(0.75)*(1/244)$ s=3.1 ms. If the regularly repeating pattern repeats over 128 PWM cycles (for example as $\omega T$ goes from 0 to 65535 in steps of 512), the regular repeating will have a repetition period of (3.1 ms)*(128)=0.40 s.

Figure 7:
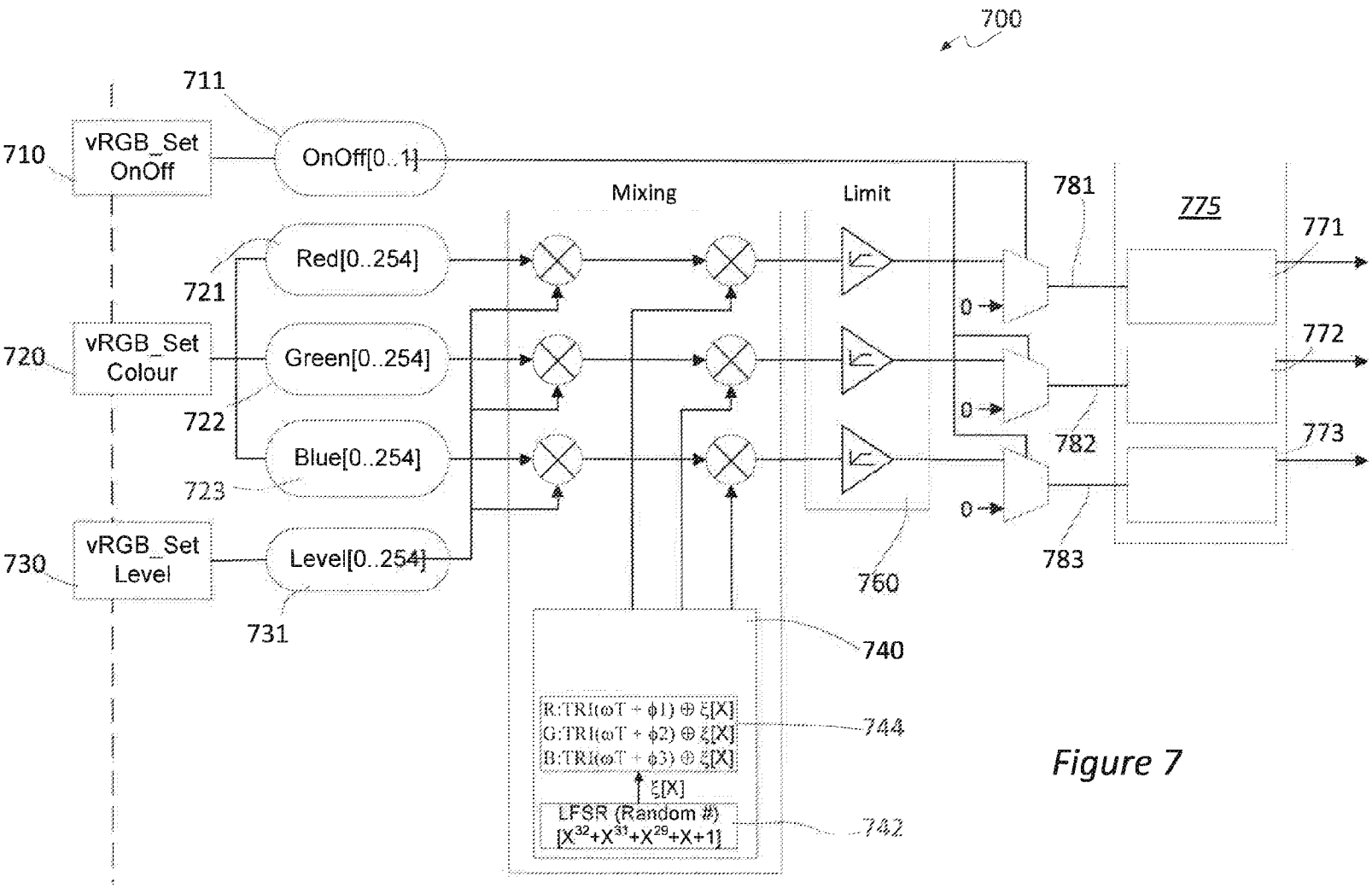
FIG. 7 shows a schematic diagram of a circuit for controlling a plurality of LED strings, according to one or more embodiments.

In an experimental setup of such an embodiment, the ripple at the output of the SMPS providing power to the LED strings has been found to halve from 4V to 2V, for LED strings operable at 18V FIG. 7 shows a schematic diagram of a circuit 700 for controlling a plurality of LED strings, according to one or more embodiments, in the context of an example application. The circuit may be implemented either in hardware or software, or a combination of both. In the case of software implementation, the controller may be partly or completely contained within a single integrated circuit such as a microcontroller chip. The controller has control inputs for the lighting circuit as follows: 710 for receiving an on-off signal (vRGB_SetOnOff), 720 for receiving a colour point signal (vRGB_SetColour), and 730 for receiving a level signal (vRGB_SetLevel). The controller converts signals at input 710, 720, 730 into corresponding driver parameters as follows: 711: OnOff; 721: Red, 722: Green and 723: Blue; and 731: Level). For a typical 8-bit implementation used in conjunction with the Zigbee Cluster Library, each of these parameters may have a value between 0 and 254—the skilled person will be familiar that the sentinel value 255 is forbidden in such applications. The red, green and blue parameters are mixed with the level parameter, in order to determine an appropriate mark-space ratio, or duty cycle, for each of the PWM signals corresponding to red, green and blue.

A spread spectrum controller 740 operates as a frequency adjuster or frequency modulator: the spread spectrum controller 740 comprises a random number generator 742 for providing jitter, which is combined by Boolean XOR logic with a triangular function TRI(x) (as shown as 744). The triangular function—which in this instance is the regular repeating pattern—has period $2\pi T$ and thus frequency $1/2\pi T$, and the patterns for the green and blue are offset by $2\pi T/3$ and $4\pi T/3$ respectively from the "red" pattern. In software-based embodiments, the spread spectrum controller may be implemented as an Interrupt Service Routine (ISR).

For example and without limitation, the random number generator may be a 9-bit truncation of a 32-bit maximal period Galois LFSR (linear feedback shift register) polynomial of the form $X^{32}+X^{31}+X^{29}+X+1$. Such a random number generator provides a 9-bit random number (i.e. a number between 0 and 255), with a generally uniform distribution. Other alternative implementations of random number generators which may be used will be familiar to the skilled person.

The output from the spread spectrum controller for each colour string is mixed with the driver parameter 721, 722 or 723 respectively, and passed to a limiter 760 in order to ensure that the appropriate LED string is not over-driven. An over-driven LED string may be one in which the average current is higher than that recommended for the one or more LEDs in the string. The outputs of the limited 760 are each combined (through Boolean "AND" logic) with the set_OnOff signal 711, before being passed as input 781, 782 or 783 to a respective red, green or blue timer block 771, 772 or 773. The timer blocks generate respective PWM signals and implement the frequency adjustment according to the inputs 781, 782 and 783.

In one or more example embodiments the timer blocks 771, 772 and 773 are implemented in software, and are at least a part of the on-chip peripherals 775. They may include registers—for example 16-bit registers—for storing, for each string, information indicative or representative of the PWM frequency, and the PWM duty cycle. A CPU (Central processor unit), may determine the information, for instance from the driver parameters 711, 721-723, 731 and the spread spectrum controller ISR. In such an embodiment, the duty cycle and one of the PWM frequency or PWM period, may thus be represented by a number between 0 and 65535. By extension, in embodiments in which the timer blocks are implemented in software using 24-bit registers, the PWM duty cycles and either PWM frequencies or PWM periods may be represented by a number between 0 and 16777215 ($2^{24}-1$).

Figure 8:
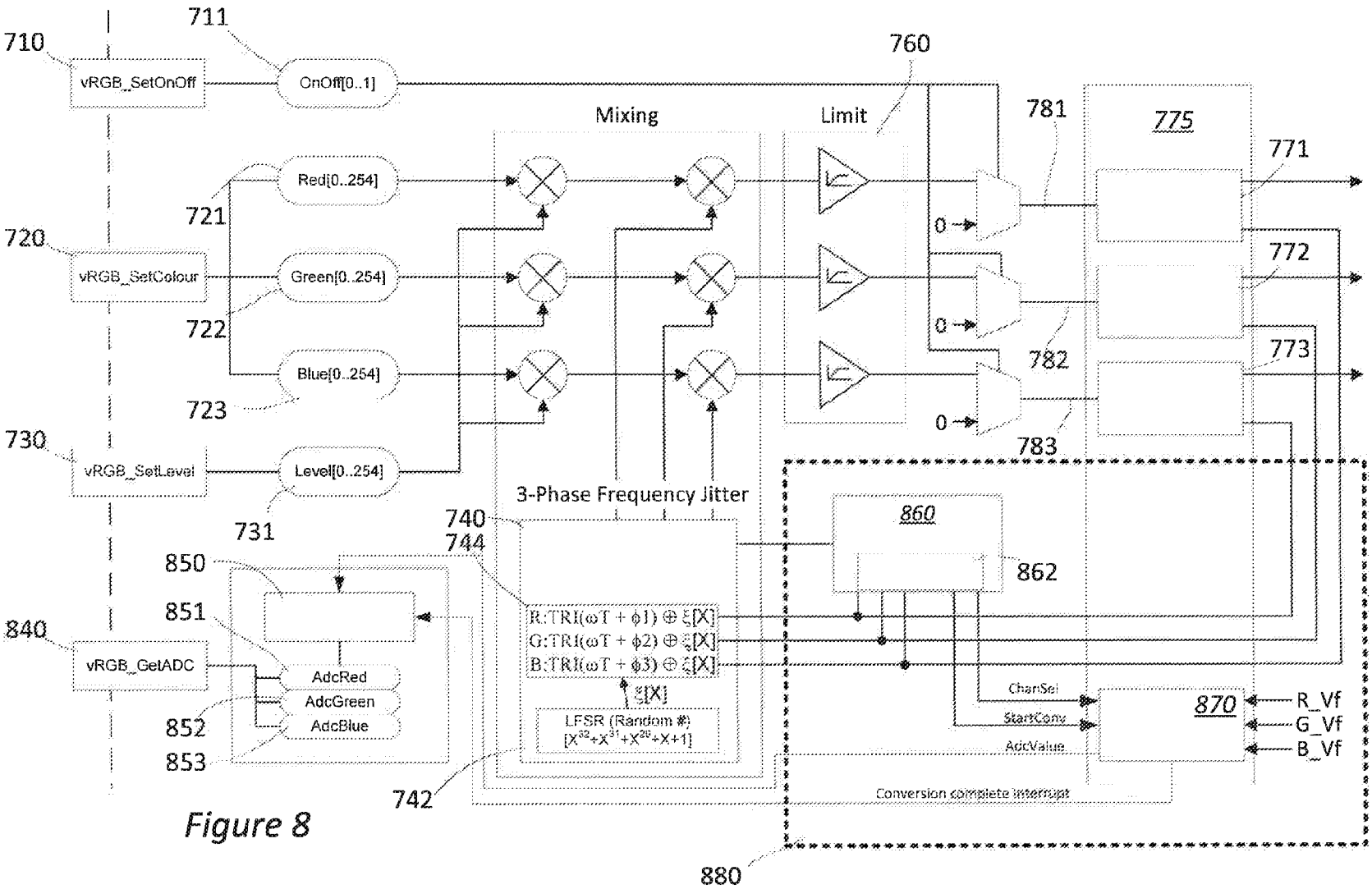
FIG. 8 shows a schematic diagram of a circuit for controlling a plurality of LED strings, according to one or more embodiments and incorporating a sensorless temperature sensing functionality.

FIG. 8 shows a schematic diagram of a circuit for controlling a plurality of LED strings, according to one or more embodiments and incorporating a sensorless temperature sensing functionality. Most of the functionality of the embodiment shown in FIG. 8 is the same or similar as that described above with reference to FIG. 7 with the exception that the, the circuit shown in FIG. 8 includes a further control input "GetADC" 840, which receives driver parameters AdcRed 851, AdcGreen 852 and AdcBlue 853, based on the output of a "conversion complete" interrupt service routine (ISR) 850. An ADC Timing block 860 is passed the PWM outputs of each of the timer blocks 771, 772 and 773. The ADC timing block 860 includes a scheduling algorithm, and determines a period when none of the RGB channel PWM signals are high, and checks that this period is long enough to make a "quiescent" measurement. A "quiescent" measurement of the relevant LED or LED string may then made by passing a small current through the LED or LED string, and determining the forward voltage across it (R-Vf, G_Vf, or B_Vf, for respectively the red, green and blue channels), as is described in US patent publications U.S. Pat. No. 8,278,831, and U.S. Pat. No. 8,368,505, in order to determine an operating characteristic such as temperature, of the LED or LED string. The forward voltage (R-Vf, G_Vf, or B_Vf) is converted to a digital signal in an Analog-to-Digital Converter (ADC) 870, at the end of the Settle period determined by the settle times 862. The ADC Timing block 860 and ADC 870 may form a logical "Conversion Complete" interrupt 880.

Figure 9:
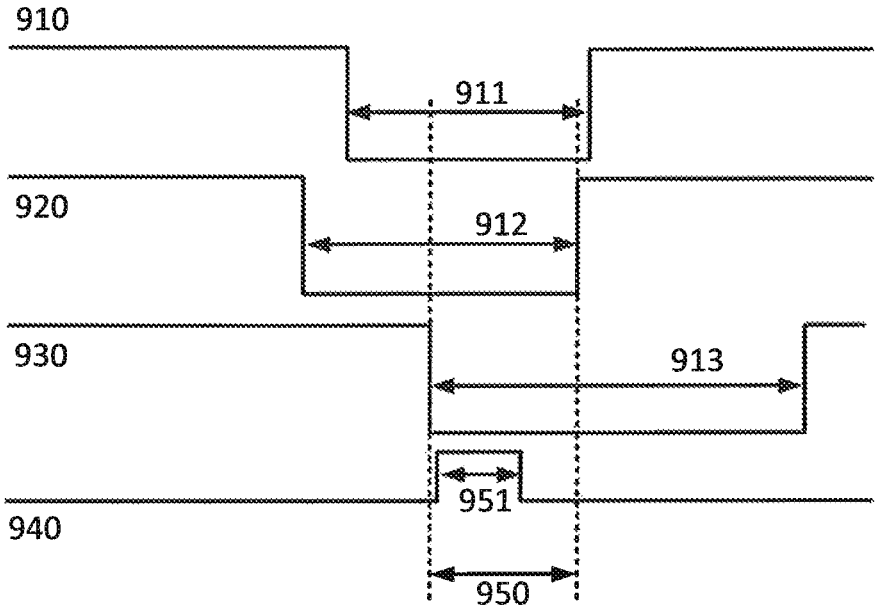
FIG. 9 shows a timing diagram for the scheduling of a sensorless temperature sensing measurement.

FIG. 9 shows, schematically, an example of the timing of the senseless sensing functionality. The figure shows expanded of the PWM signals 910, 920 and 930, for each of three channels. The PWM frequencies of the three channels are different, as shown by the different durations, 911, 912, 913 of the three "off" periods of their duty cycles. To avoid crosstalk from the other channels, it is preferable that the quiescent measurement of any one of the channels is made during a time when the other channels are also off—that is to say, during period 950. The lower trace 940 shows the output of the scheduling algorithm. The algorithm determines that it is possible to schedule a quiescent measurement—that is, measurement of the forward voltage Vf for a low, nearly-off, current, during only a first part 951 of the window 950. It would not be appropriate to schedule a quiescent measurement during the latter part of the window, due to the length of time required for the measurement.

Thus by introducing partially-controlled randomness into the PWM frequency for each of the PWM control signals according to one more embodiments such as those described above, it may be possible to conveniently schedule measurements for senseless sensing functionality with a high reliability and avoid being crosstalk, without requiring significant additional complexity.

From reading the present disclosure, other variations and modifications will be apparent to the skilled person. Such variations and modifications may involve equivalent and other features which are already known in the art of LED lighting controllers, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination. The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the and reference signs in the claims shall not be construed as limiting the scope of the claims.

LIST OF REFERENCE SYMBOLS

100 lighting circuit
110 AC mains
115 rectifier
120 DC-DC converter
125 microcontroller
131, 132, 133 LED driver
141, 142, 143 LED string
200 lighting circuit
210 PWM signal generator
215 information representative of duty cycle
220 frequency modulator
230 jitter module
240 envelope shaper u
300 controller
311, 312, 313 signal generator
321, 322, 323 frequency adjustor modulator
330 jitter unit
331, 332, 333 jitter module
340 envelope shaper unit
341, 342, 343 envelope shaper module
410, 420, 430 regular repeating pattern
411, 421, 431 upper limit
412, 422, 432 lower limit
510 triangular waveform
520 sawtooth waveform
530 sinusoidal waveform
540 skewed triangular waveform
610 regular repeating pattern
612 maximum allowable jitter
614, 624 upper limit
616, 626 lower limit
700 circuit 700
710 onoff control input
711 OnOff driver parameter
720 colour point signal control input
721 red driver parameter
722 green driver parameter
723 Blue driver parameter
730 level signal control input
731 Level drive parameter
740 spread spectrum controller
742 random number generator
744 triangular function TRIO
760 limiter
771 red timer block
772 green timer block
773 blue timer block
775 on-chip peripherals
781 input to red timer block
782 input to green timer block
783 input to blue timer block
840 GetADC control input
850 conversion complete ISR
851 AdcRed driver parameter
852 AdcGreen driver parameter
853 AdcBlue driver parameter
860 ADC Timing block 860
862 Settle times
870 ADC
880 "Conversion Complete" interrupt
910, 920, 930 PWM signals
911, 912, 913 PWM signal "off" periods
940 scheduling algorithm output
950 quiescent period
951 scheduling algorithm output high period

The invention claimed is:

1. A controller for controlling a plurality of LED lighting strings, the controller comprising, for each of the plurality of LED lighting strings:

a frequency modulator configured to modulate a baseline frequency to generate a time-varying modulated frequency, wherein the frequency modulator is configured to modulate the baseline frequency by a jitter superposed on a regular repeating pattern which varies more slowly than the jitter, to result in the modulated frequency; and a modulated PWM signal generator configured to generate a modulated PWM signal having the modulated frequency and a predetermined duty cycle;

wherein the regular repeating patterns for the PWM signals are spaced apart in phase.

2. A controller as claimed in claim 1, wherein the jitter is random.

3. A controller as claimed in claim 1, wherein each frequency modulator comprises:

a jitter module configured to adjust the respective baseline frequency by a random amount; and an envelope shaper module configured to adjust the respective baseline frequency according to a regular repeating pattern, operable in combination with the jitter module.

4. A controller as claimed in claim 3, wherein each envelope shaper is configured to adjust the respective baseline frequency by the same regular repeating pattern.

5. A controller as claimed in claim 1, wherein each regular repeating pattern is the same one of a triangular and a saw-tooth pattern.

6. A controller as claimed in claim 1, wherein the regular repeating pattern for different PWM signals are evenly spaced apart in phase.

7. A controller as claimed in claim 1, further comprising a phase-lock circuit to lock the phases of the regular repeating pattern for different PWM signals.

8. A driver for driving a plurality of LEDs lighting strings, comprising a controller as claimed in claim 1, and a plurality of power switches, each configured to be switched according to the respective modulated PWM signal.

9. A driver as claimed in claim 8, further comprising a measuring unit, configured to determine a period of time when none of the modulated PWM signals are high, and to measure a characteristic of a one of the LED lighting strings within the period.

10. A driver as claimed in claim 9, wherein the characteristic is temperature.

11. A lighting circuit comprising a driver as claimed in claim 1 and further comprising the plurality of LED lighting strings.

12. A method of controlling a plurality of LED lighting strings, the method comprising, for each of the plurality of LED lighting strings:

modulating a baseline frequency to generate a time-vary modulated frequency, wherein the baseline frequency is modulated by a jitter superposed on a regular repeating pattern which varies more slowly than the jitter, to result in the modulated frequency;

and generating a modulated PWM signal having the modulated frequency and a predetermined duty cycle;

wherein the regular repeating patterns for the PWM signals are spaced apart in phase.

13. The method of claim 12, wherein the jitter is random.

14. The method of claim 12, wherein each regular repeating pattern is the same regular repeating pattern.

15. The method of claim 12, further comprising determining a period of time when none of the modulated PWM signals are high, and measuring a characteristic of a one of the LED lighting strings within the period.

* * * * *